US010054139B2

(12) United States Patent
Toparcean et al.

(10) Patent No.: US 10,054,139 B2
(45) Date of Patent: Aug. 21, 2018

(54) HYDRAULIC TOOLS WITH RAPID ADVANCE

(71) Applicant: Ridge Tool Company, Elyria, OH (US)

(72) Inventors: Ionut Toparcean, Cluj (RO); Sorin Dan Mascas, Cluj (RO); Cosmin Valeriu Popa, Alba (RO); Stefan Ionut Craciun, Bistrita-Nasaud (RO)

(73) Assignee: Ridge Tool Company, Elyria, OH (US)

( * ) Notice: Subject to any disclaimer, the term of this patent is extended or adjusted under 35 U.S.C. 154(b) by 346 days.

(21) Appl. No.: 14/753,422

(22) Filed: Jun. 29, 2015

(65) Prior Publication Data

US 2016/0010667 A1 Jan. 14, 2016

Related U.S. Application Data

(60) Provisional application No. 62/024,011, filed on Jul. 14, 2014.

(51) Int. Cl.

| | |
|---|---|
| ***F15B 11/02*** | (2006.01) |
| ***F15B 15/20*** | (2006.01) |
| ***B25B 27/10*** | (2006.01) |
| ***B30B 1/32*** | (2006.01) |
| ***B30B 15/16*** | (2006.01) |
| *B21D 39/04* | (2006.01) |
| *H01R 43/042* | (2006.01) |

(52) U.S. Cl.

CPC ..... *F15B 15/204* (2013.01); *B25B 27/10* (2013.01); *B30B 1/326* (2013.01); *B30B 15/16* (2013.01); *B21D 39/048* (2013.01); *F15B 11/022* (2013.01); *H01R 43/0427* (2013.01)

(58) Field of Classification Search

CPC .... F15B 15/204; F15B 11/022; F15B 11/0325

USPC ..... 60/477, 479

See application file for complete search history.

(56) References Cited

U.S. PATENT DOCUMENTS

| | | | | |
|---|---|---|---|---|
| 4,339,942 | A | 7/1982 | Svensson | |
| 4,823,588 | A * | 4/1989 | Bussereau | F15B 11/036 60/477 |
| 5,586,482 | A | 12/1996 | Leonard | |
| 5,979,215 | A | 11/1999 | Lefavour et al. | |
| 6,446,482 | B1 | 9/2002 | Heskey et al. | |
| 6,718,870 | B1 | 4/2004 | Frenken | |
| 2003/0041644 | A1 | 3/2003 | Lefavour et al. | |

FOREIGN PATENT DOCUMENTS

| | | |
|---|---|---|
| EP | 0602425 | 6/1994 |
| FR | 2242584 | 3/1975 |

OTHER PUBLICATIONS

International Search Report (ISR) and Written Opinion; PCT/US2015/35538; dated Nov. 23, 2015 (12 Pages).

Extended European Search Report for Application No. 15821661.4; dated Feb. 9, 2018; 8 Pages.

* cited by examiner

*Primary Examiner* — F. Daniel Lopez
*Assistant Examiner* — Daniel Collins
(74) *Attorney, Agent, or Firm* — Mark E. Bandy; Rankin, Hill & Clark LLP

(57) ABSTRACT

Hydraulic tools having extendable rams for performing various functions such as crimping are described. The tools include a hydraulic system that enables the ram to be rapidly advanced. Methods using the hydraulic systems and tools are also described.

22 Claims, 10 Drawing Sheets

HYDRAULIC TOOLS WITH RAPID ADVANCE

CROSS REFERENCES TO RELATED APPLICATIONS

The present application claims priority upon U.S. provisional application Ser. No. 62/024,011 filed Jul. 14, 2014.

FIELD

The present subject matter relates to hydraulic tools with a rapid ram advance feature. The subject matter also relates to hydraulic systems equipped with the rapid ram advance feature, and related methods using such systems.

BACKGROUND

Hydraulic tools generally include a hydraulic ram or piston that can be extended to perform work such as crimping of workpieces or other functions. Ram extension is performed by pumping hydraulic fluid, under pressure, behind the ram thereby causing displacement of the ram. For hydraulic tools that include a manually operated pump such as a handle pump, performing a large number of repeated crimpings or other operations requires a corresponding large number of pumping operations by a user. This can become burdensome and significantly reduce the rate of operations performed by the user.

Hydraulic systems are known which provide rapid ram extension during no load conditions or prior to a ram position at which work is to be performed. A variety of strategies have been devised to increase the speed of ram extension. However, many if not all strategies involve complex hydraulic assemblies, and intricate hydraulic systems of valving and seals. As will be appreciated, such assemblies increase manufacturing costs and can be difficult to maintain. Accordingly, a need remains for new hydraulic systems, related methods, and tools using such hydraulic systems which are reliable and easy to maintain and which do not increase manufacturing costs.

SUMMARY

The difficulties and drawbacks associated with previously known hydraulic tools and systems are addressed in the present subject matter as follows.

In one aspect, the present subject matter provides a hydraulic system comprising a reservoir adapted to contain hydraulic fluid. The system also comprises a hydraulic cylinder defining a hollow interior and including a ram disposed therein. The ram defines a first face and an oppositely directed second working face. The interior of the cylinder and the first face of the ram define a primary chamber. The ram is positionable through a first phase of ram extension and a second phase of ram extension. The system also comprises a pushrod assembly including a housing defining a hollow interior and a pushrod positionably disposed therein. The pushrod defines a first end and an oppositely directed second end. The interior of the housing and the first end of the pushrod define a secondary chamber. The pushrod and the ram are in at least periodic operable engagement such that extension of the pushrod causes extension of the ram. The pushrod and housing include provisions to preclude fluid flow between the primary chamber and the secondary chamber when the pushrod is within a range of positions corresponding to the first phase of ram extension, and permit fluid flow between the primary chamber and the secondary chamber when the pushrod is within a range of positions corresponding to the second phase of ram extension.

In another aspect, the present subject matter provides a method of extending a hydraulic ram in which the ram is extended at a first rate of extension and then at a second rate of extension. The first rate of extension is greater than the second rate of extension. The method comprises providing a hydraulic system including (i) a reservoir containing hydraulic fluid, (ii) a hydraulic cylinder and ram positionably disposed therein, the cylinder and ram defining a primary chamber, (iii) a pushrod assembly having a housing and a pushrod positionably disposed therein, the housing and pushrod defining secondary chamber, the pushrod and the ram being in at least periodic operable engagement such that extension of the pushrod causes extension of the ram, and (iv) provisions for precluding fluid flow between the primary chamber and the secondary chamber at a first range of positions of the pushrod and permitting fluid flow between the primary chamber and the secondary chamber at a second range of positions of the pushrod relative to the housing. The method also comprises directing hydraulic fluid into the secondary chamber to thereby extend the pushrod and cause extension of the ram, whereby ram extension occurs at a first rate of extension. The method additionally comprises directing hydraulic fluid into the primary chamber to thereby extend the ram at a second rate of extension. The first rate of extension is greater than the second rate of extension.

In yet another aspect, the present subject matter provides a hydraulic tool comprising a tool body, and a tool head secured to the tool body. The tool head includes a positionable work member for performing at least one operation on a workpiece. The tool also comprises a hydraulic system generally disposed within the tool body. The hydraulic system includes (i) a reservoir adapted to contain hydraulic fluid, (ii) a hydraulic cylinder defining a hollow interior and including a ram disposed therein, the ram defining a first face and an oppositely directed second working face, the interior of the cylinder and the first face of the ram defining a primary chamber, the ram positionable through a first phase of ram extension and a second phase of ram extension, and (iii) a pushrod assembly including a housing defining a hollow interior and a pushrod positionably disposed therein. The pushrod defines a first end and an oppositely directed second end. The interior of the housing and the first end of the pushrod define a secondary chamber. The pushrod and the ram are in at least periodic operable engagement such that extension of the pushrod causes extension of the ram. The pushrod and housing include provisions to preclude fluid flow between the primary chamber and the secondary chamber when the pushrod is within a range of positions corresponding to the first phase of ram extension, and permit fluid flow between the primary chamber and the secondary chamber when the pushrod is within a range of positions corresponding to the second phase of ram extension. The ram is engageable with the work member of the tool head.

As will be realized, the subject matter described herein is capable of other and different embodiments and its several details are capable of modifications in various respects, all without departing from the claimed subject matter. Accordingly, the drawings and description are to be regarded as illustrative and not restrictive.

DETAILED DESCRIPTION OF THE EMBODIMENTS

Figure 1:
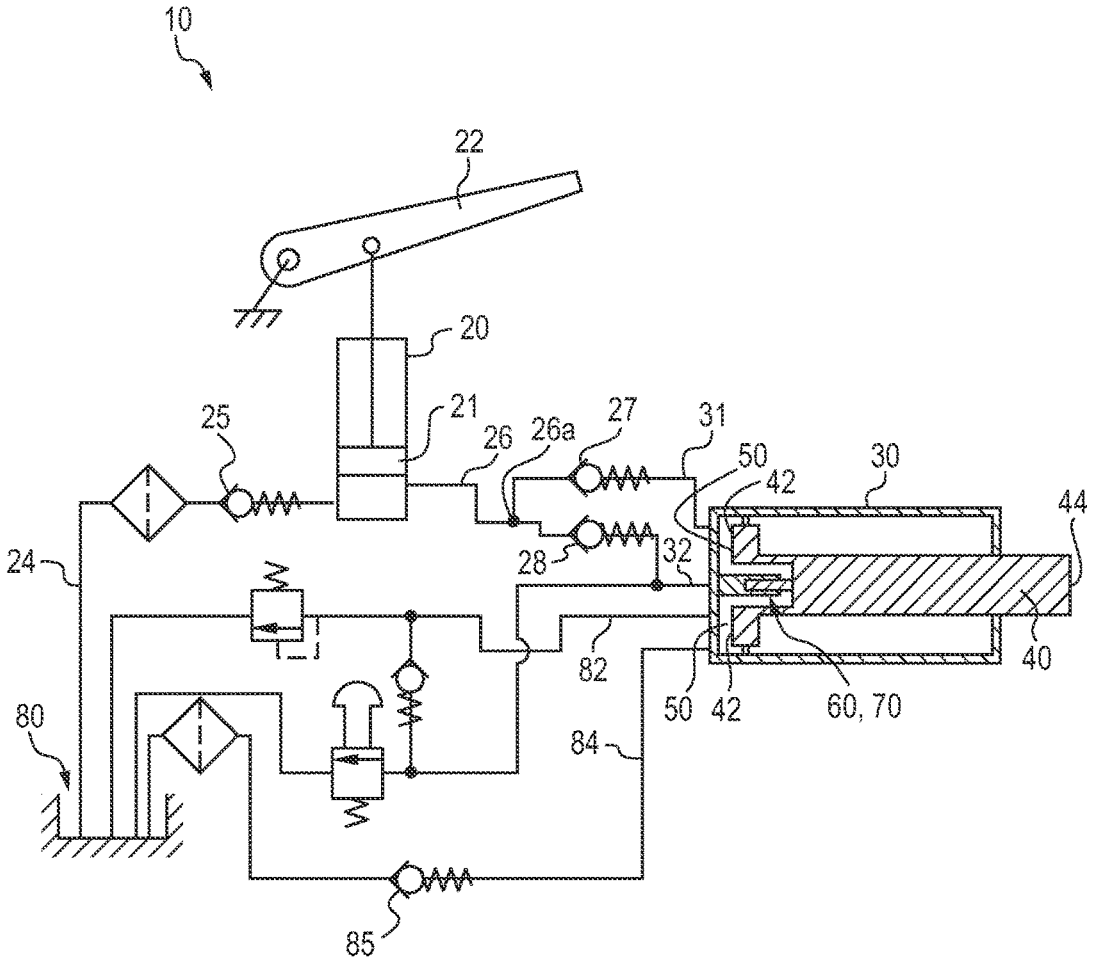
FIG. 1 is a schematic diagram of an embodiment of a hydraulic system used in conjunction with a rapid ram feature of the present subject matter.

The present subject matter relates to systems for rapidly advancing a hydraulic piston. The systems include a primary chamber, a hydraulic ram or piston positionable therein, a secondary chamber typically smaller and disposed along a face of the hydraulic ram, a pushrod disposed within the secondary chamber, and two hydraulic fluid lines each with flow valves that deliver hydraulic fluid from a pump to one or both chambers to thereby advance or extend the ram.

More specifically, in certain embodiments of the present subject matter, the pushrod and the ram are configured and arranged such that extension of the pushrod causes extension of the ram. In an initial or first phase of ram extension, hydraulic fluid is directed into the secondary chamber thereby causing extension of the pushrod. Due to the configuration of the secondary chamber, the rate of pushrod extension is relatively high. Linear displacement of the pushrod causes linear displacement and thus extension of the ram, which also occurs at this relatively high rate.

Extension of the pushrod and ram continues until at a particular position of the pushrod relative to the secondary chamber, hydraulic fluid is permitted to flow from the secondary chamber to the primary chamber. This begins a second phase of ram extension characterized by a lower rate of extension as compared to that of the first phase of ram extension. During the second phase of ram extension, relatively large forces can be delivered by the ram as described in greater detail herein.

In particular embodiments of the present subject matter, the pushrod is configured such that when the pushrod is within a range of positions corresponding to the first phase of ram extension, fluid communication between the primary and secondary chambers is precluded or at least substantially so as described in greater detail herein. And, when the pushrod is within a range of positions corresponding to the second phase of ram extension, fluid communication between the primary and secondary chambers is permitted. As noted, in particular embodiments the pushrod is configured to preclude or substantially preclude fluid flow between the chambers. Although a very small amount of fluid may potentially pass between the pushrod and an inner wall of the secondary chamber, the amount of fluid and/or extent of flow is insufficient to result in a significant pressure loss in the secondary chamber, thereby permitting the rapid advance of the pushrod as described herein. Thus, the terms "preclude fluid flow" and "precluding fluid flow" as used herein refer to either no fluid flow or a relatively minor fluid flow between the primary and secondary chambers in which the maximum volume of fluid passing between the pushrod and the inner wall of the secondary chamber is less than 16% of the total volume of fluid displaced by a single pumping action, i.e., one full extension of the ram. In many embodiments, the maximum volume of fluid is less than 10%, more particularly less than 5%, and in certain embodiments is only about 1.5% of the total volume of fluid displaced by a single pumping action.

In one embodiment, the pushrod has a "free flow" configuration along a portion of its length that permits such fluid communication when the pushrod is within the range of positions corresponding to the second phase of ram extension. The free flow configuration includes a flat surface region that extends from one end of the pushrod toward the other end, but which terminates at a location on the pushrod that generally constitutes the transition between the first and second phases of ram extension. The flat region enables hydraulic fluid to pass alongside the flat region of the pushrod when the pushrod is in the range of positions corresponding to the second phase of ram extension.

The free flow configuration may also include a recessed channel extending around at least a majority of the circumference of the pushrod at the noted transition location. This recessed channel can be in the form of a recessed circumferential band. The recessed band extends around at least a portion of the circumference of the pushrod. In certain embodiments of the present subject matter, the recessed band extends entirely around the circumference or outer perimeter of the pushrod. The flat region defined along a portion of the length of the pushrod extends between an end of the pushrod and the band or circumferential channel. The recessed circumferential channel promotes positioning of the pushrod and in particular, maintaining the pushrod in a centered position within its housing and/or the secondary chamber as described in greater detail herein. As a result of the recessed channel, hydraulic fluid under pressure, is directed into that channel, and around the circumference of the pushrod thereby centering the pushrod within its housing and/or the secondary chamber.

In certain embodiments, hydraulic systems using pushrods as described herein and particularly those that exhibit the noted free flow feature, are devoid of seals or other fluid-sealing components around the pushrod. Thus, in such versions of the present subject matter, the pushrods or pushrod assemblies are free of hydraulic seals.

The present subject matter also relates to methods of extending hydraulic rams in which the rate of extension during the noted first phase of ram extension is greater than the rate of extension during the noted second phase of ram extension. The methods involve the use of a hydraulic system as described herein and one that includes provisions for precluding fluid flow between the primary chamber and the secondary chamber at pushrod positions which correspond to the first phase of ram extension. The provisions also permit fluid flow between the primary chamber and the secondary chamber at pushrod positions which correspond to the second phase of ram extension.

The methods also involve directing hydraulic fluid into the secondary chamber from a pump or other pressure source to thereby extend the pushrod and cause extension of the ram. As noted, during this first phase of ram extension, the rate of ram extension is relatively high. Extension of the pushrod continues until a particular position of the pushrod relative to the secondary chamber is reached and the free flow feature then permits fluid communication between the secondary and primary chambers. As the pushrod is displaced from the previously noted transition position and within the range of positions corresponding to the second phase of ram extension, the rate of ram extension is less than the rate of ram extension in the first phase.

The methods also involve directing hydraulic fluid into the primary chamber from the pump or other pressure source to further extend the ram. Typically, flow of hydraulic fluid into the primary chamber is governed by one or more valves as described in greater detail herein. During this second phase of ram extension, hydraulic fluid may be, and in many instances is also being, concurrently directed into the second chamber. And, as previously noted, during the second phase of ram extension, the free flow configuration permits fluid communication between the primary chamber and the secondary chamber.

Table 1 set forth below summarizes various relationships and states associated with the first relatively rapid phase of ram extension and the slower second phase of ram extension in certain embodiments of the present subject matter.

TABLE 1

First and Second Phases of Ram Extension

| Phase of Ram Extension | Relative Rate of Ram Extension | Fluid Communication Between Primary and Secondary Chambers? | Fluid Flow From Pump Into Secondary Chamber? | Fluid flow From Pump Into Primary Chamber? |
|---|---|---|---|---|
| First | Fast | No | Yes | No |
| Second | Slow | Yes | Permitted | Yes |

The present subject matter also relates to tools that include the hydraulic systems described herein. Generally, the tools comprise a tool body or frame and a tool head at which one or more operations are performed upon workpiece(s). The tool head typically includes one or more work members which may be in a variety of different forms. Nonlimiting examples of such work members include dies such as crimping dies, jaws, shaping or forming members, and the like. At least one of the work members is engaged or engageable with the ram of the hydraulic systems described herein.

FIG. 1 is a schematic diagram of a hydraulic system 10 in accordance with the present subject matter. The system 10 comprises a pump 20 for displacing hydraulic fluid. The pump includes a handle 22 for displacing a pump piston 21 as known in the art. The system 10 also comprises a hydraulic cylinder 30 having a ram 40 movably disposed within a hollow interior of the hydraulic cylinder 30. The ram defines a first face 42 and a second face 44 oppositely directed from the first face 42. The interior of the cylinder 30 and the first face 42 of the ram 40 define a primary chamber 50. The system 10 also comprises a pushrod assembly 60 described in greater detail herein and which provides a secondary chamber 70. The system 10 also comprises a reservoir 80 which stores hydraulic fluid.

The system 10 additionally comprises various fluid flow lines and valves. For example, the system 10 includes a pump inlet line 24 providing flow communication between the reservoir 80 and the pump 20. One or more valves such as a one-way valve 25 can be included in the inlet line 24 precluding flow from the pump to the reservoir 80. The system 10 also includes a pump outlet line 26, a splitter or diverter **26*a*, a first fluid flow line 31 providing fluid communication between the pump 20 and the primary chamber 50, and a second fluid flow line 32 providing fluid communication between the pump 20 and the secondary chamber 70. In many versions of the present subject matter, the flow lines 31 and 32 are in a parallel configuration with each other. One or more valves such as a one-way valve 27 can be included in the line 31 precluding flow from the primary chamber 50 to the pump 20. And, one or more valves such as a one-way valve 28 can be included in the line 32 precluding flow from the secondary chamber 70 to the pump 20. In certain embodiments of the present subject matter, the valve 27 permits fluid flow from the pump 20 to the primary chamber 50 only at certain designated fluid pressures, or at pressures that exceed a valve biasing pressure. And, the valve 28 permits fluid flow from the pump 20 to the secondary chamber 70 only at certain designated fluid pressures, which are typically less than those associated with the valve 27**.

The system 10 may also comprise a reservoir return line 82 providing fluid communication between the primary chamber 50 and the reservoir 80, and particularly from the primary chamber to the reservoir which occurs during ram retraction. And, the system 10 may also comprise a reservoir suction line 84 providing fluid communication between the primary chamber 50 and the reservoir 80. One or more valves such as a one way valve 85 can be included in the flow line 84 permitting fluid from the reservoir 80 to the primary chamber 50 of the cylinder 30, but precluding flow in the reverse direction. The hydraulic system 10 can include a wide array of additional components and/or utilize variant hydraulic circuits such as described in U.S. Pat. Nos. 4,206,603; 5,836,400; 6,718,870; and 7,124,608.

Figure 2:
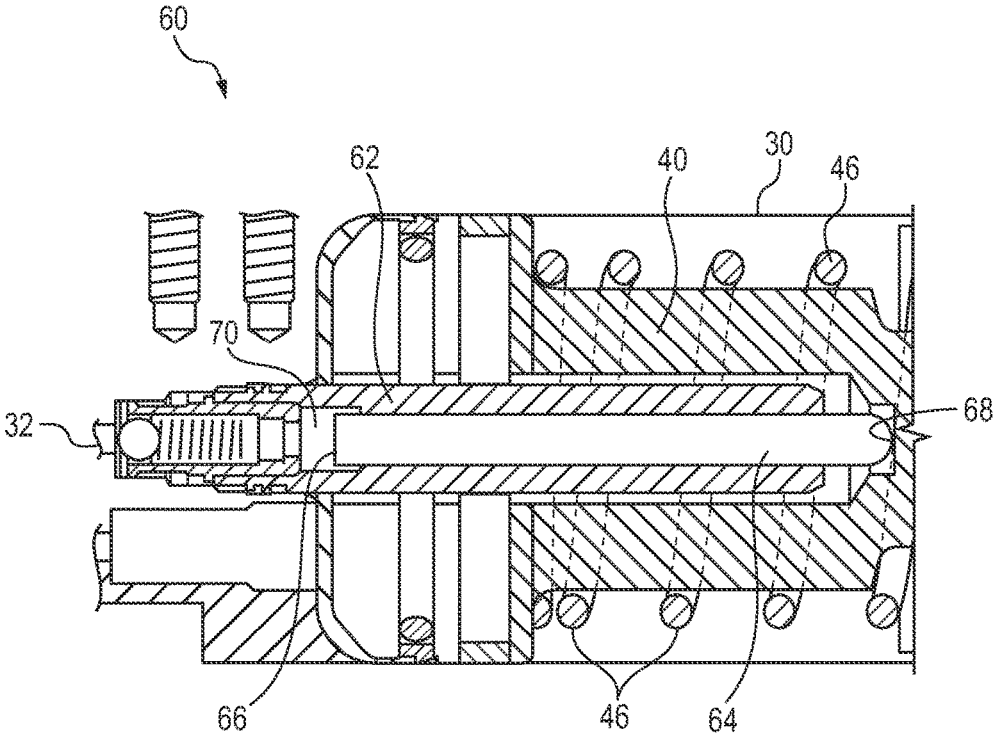
FIG. 2 is a schematic cross sectional view of an embodiment of a hydraulic assembly including a push rod in accordance with the present subject matter.

FIG. 2 is a schematic cross sectional view of a hydraulic assembly embodying the hydraulic system 10 of FIG. 1 illustrating the pushrod assembly 60 and the secondary chamber 70 in greater detail. The pushrod assembly 60 includes a housing 62 with a hollow interior and a pushrod 64 movably disposed therein. The pushrod 64 defines a first end 66 and an oppositely directed second end 68. The interior of the housing 62 and the first end 66 of the pushrod 64 define the secondary chamber 70. The secondary chamber inlet line 32 provides fluid communication between the pump 20 and the secondary chamber 70. FIG. 2 also illustrates one or more biasing members such as a spring 46 that biases the ram 40 to a desired position such as toward a fully retracted position.

Figure 3:
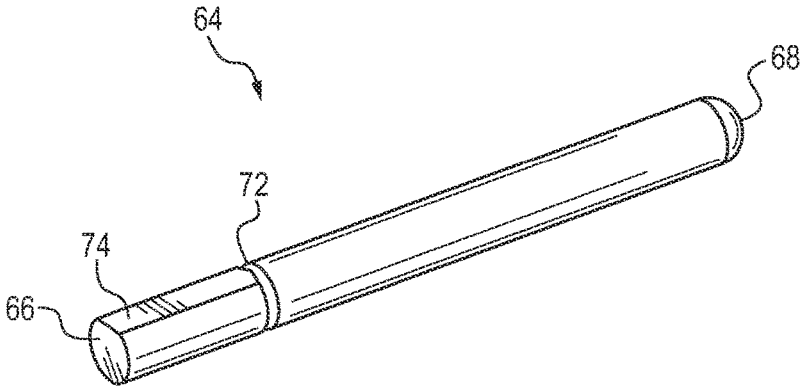
FIG. 3 is a perspective view of an embodiment of a push rod in accordance with the present subject matter.

FIG. 3 is a perspective view of a particular version of the pushrod 64 in accordance with the present subject matter. The pushrod 64 defines the previously noted first end 66 and the opposite second end 68. The pushrod 64 also includes a recessed band 72 extending around the circumference or perimeter of the pushrod 64. In certain versions, the pushrod could have a non-circular cross sectional shape. In such versions, the recessed band 72 extends around the perimeter of the pushrod. As previously described, the recessed band or channel 72 promotes centering of the pushrod 64 within its housing 62. The band 72 is located between the ends 66 and 68. As previously described, the recessed band or channel 72 can promote centering of the pushrod 64 within its housing 62. For example, if the housing 62 defines a cylindrically shaped interior hollow region, and a suitably sized and cylindrically shaped pushrod with the recessed band is disposed therein; hydraulic fluid is retained within the recess and if under pressure, the fluid urges the pushrod to an axially located centermost position within the hollow region of the housing. The pushrod 64 also includes a flat outer surface region 74 extending between the first end 66 and the recessed band 72. This flattened region 74 creates a widened interface with an interior surface of the housing 62, along which hydraulic fluid collects and in certain positions of the pushrod, flows along a portion of the length of the pushrod 64. In certain versions of the pushrod 64, the second end 68 is provided with a conical, pointed, or hemispherical configuration. Such geometries reduce the amount of contact between the second end 68 of the pushrod 64 and the ram 40.

Figure 4:
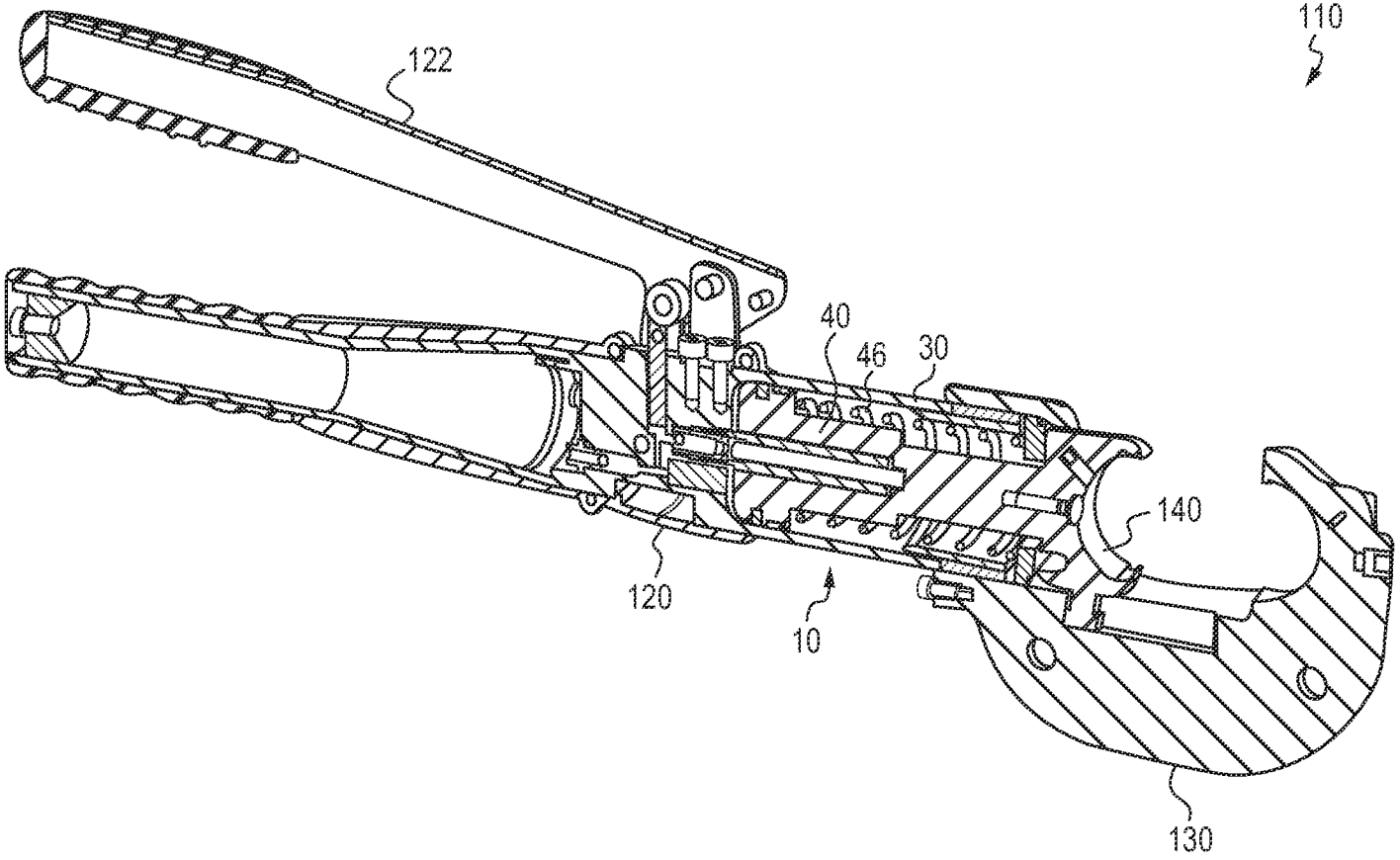
FIG. 4 is a schematic cross sectional view of a hydraulic tool including an embodiment of a hydraulic assembly in accordance with the present subject matter, the tool shown in a state of ram retraction.

FIG. 4 is a schematic cross sectional view of a hydraulic tool 110 in accordance with the present subject matter. The tool 110 comprises a tool body 120 having a pump handle 122, and a tool head 130 secured or otherwise attached to the body 120. The tool head 130 includes a positionable work member 140. The tool 110 also comprises the previously noted hydraulic system 10 generally disposed in the tool body 120. The tool head 130 may be releasably affixed to the tool body 120.

The hydraulic ram 40 is engaged or otherwise engageable with the work member 140 such that extension or retraction of the ram 40 can result in extension and/or retraction of the work member 140. The tool 110 is shown in a state of retraction of the ram 40 and the work member 140.

Figure 5:
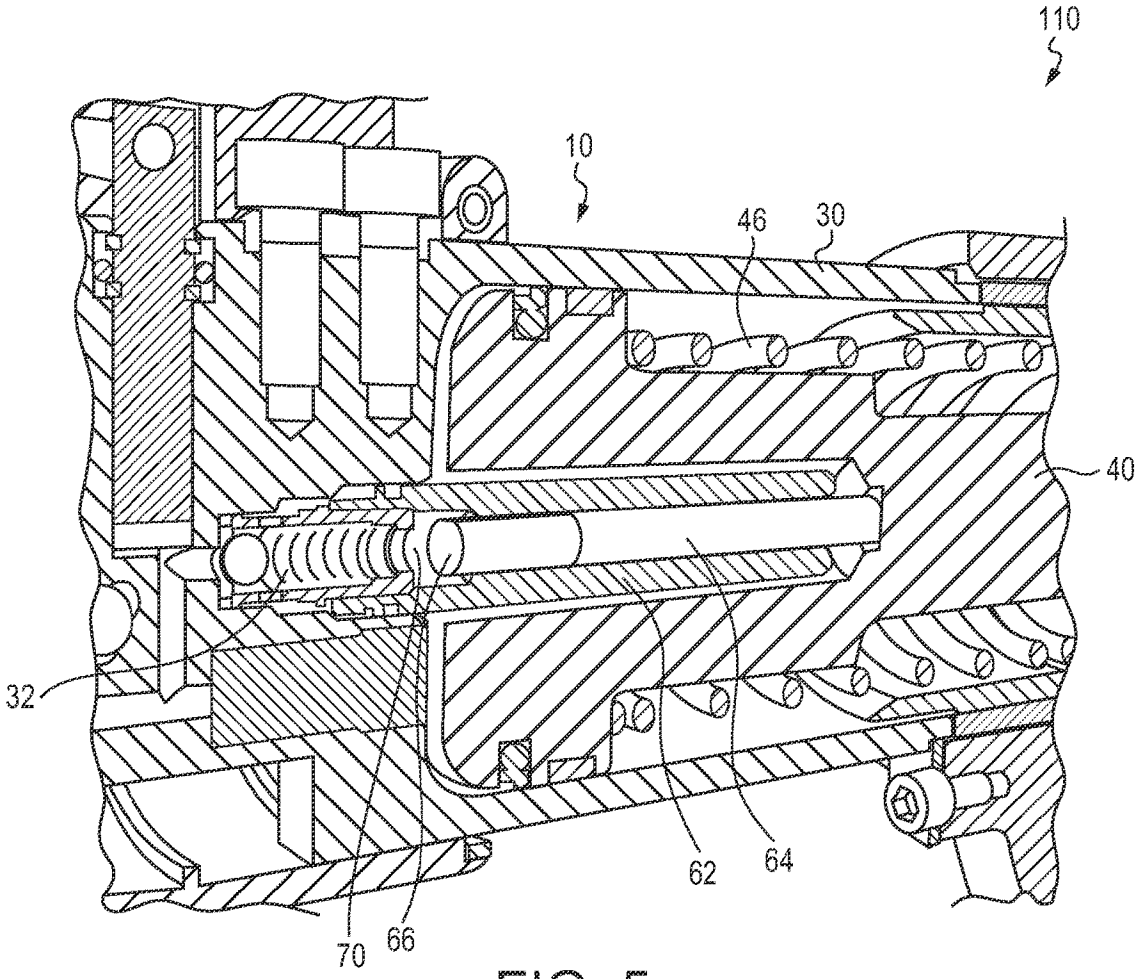
FIG. 5 is a detailed schematic sectional view of the tool of FIG. 4 illustrating the hydraulic assembly and pushrod when the tool is in a state of ram retraction.

FIG. 5 is a detailed schematic view of the tool 110 of FIG. 4 illustrating the hydraulic system 10 when the ram 40 is fully retracted. FIG. 5 also illustrates the pushrod 64 disposed in the pushrod housing 62 and the first face 66 of the pushrod 64 exposed within the secondary chamber 70. The fluid flow line 32 provides fluid communication between the pump 20 (not shown) and the secondary chamber 70.

Figure 6:
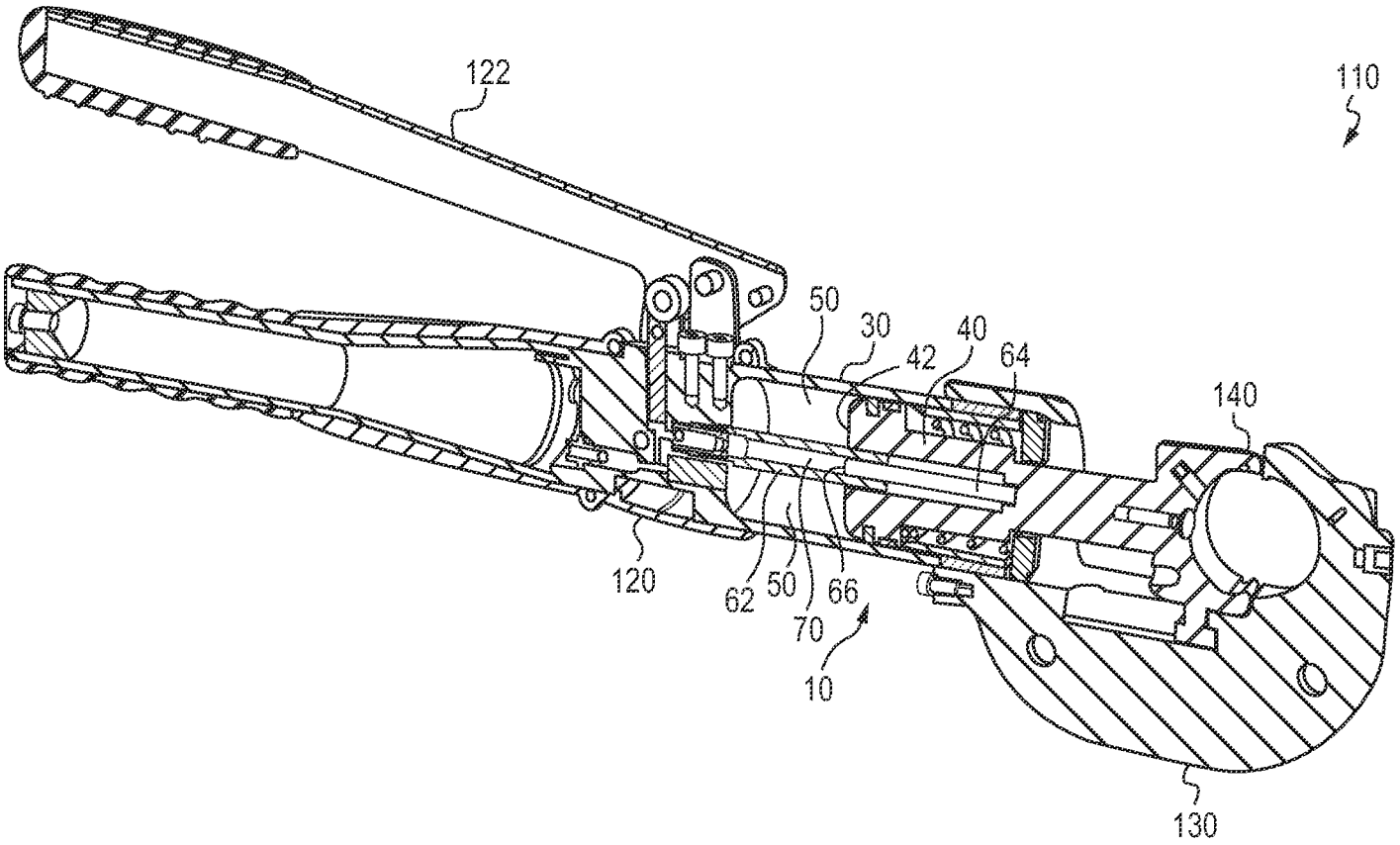
FIG. 6 is a schematic cross sectional view of the hydraulic tool depicted in FIG. 4, but the tool shown in a state of ram extension.

FIG. 6 is a schematic cross sectional view of the hydraulic tool 110 shown in FIGS. 4-5, with the tool in a state of ram extension. Specifically, the ram 40 and the work member 140 are shown in a fully extended position. The primary chamber 50 is defined by the interior of the cylinder 30 and the first face 42 of the ram 40. The secondary chamber 70 is defined by the interior of the housing 62 and the first face 66 of the pushrod 64. As will be appreciated, each of the primary and secondary chambers 50 and 70, vary in volume depending upon the positions of the ram 4 and the pushrod 64, respectively.

Figure 7:
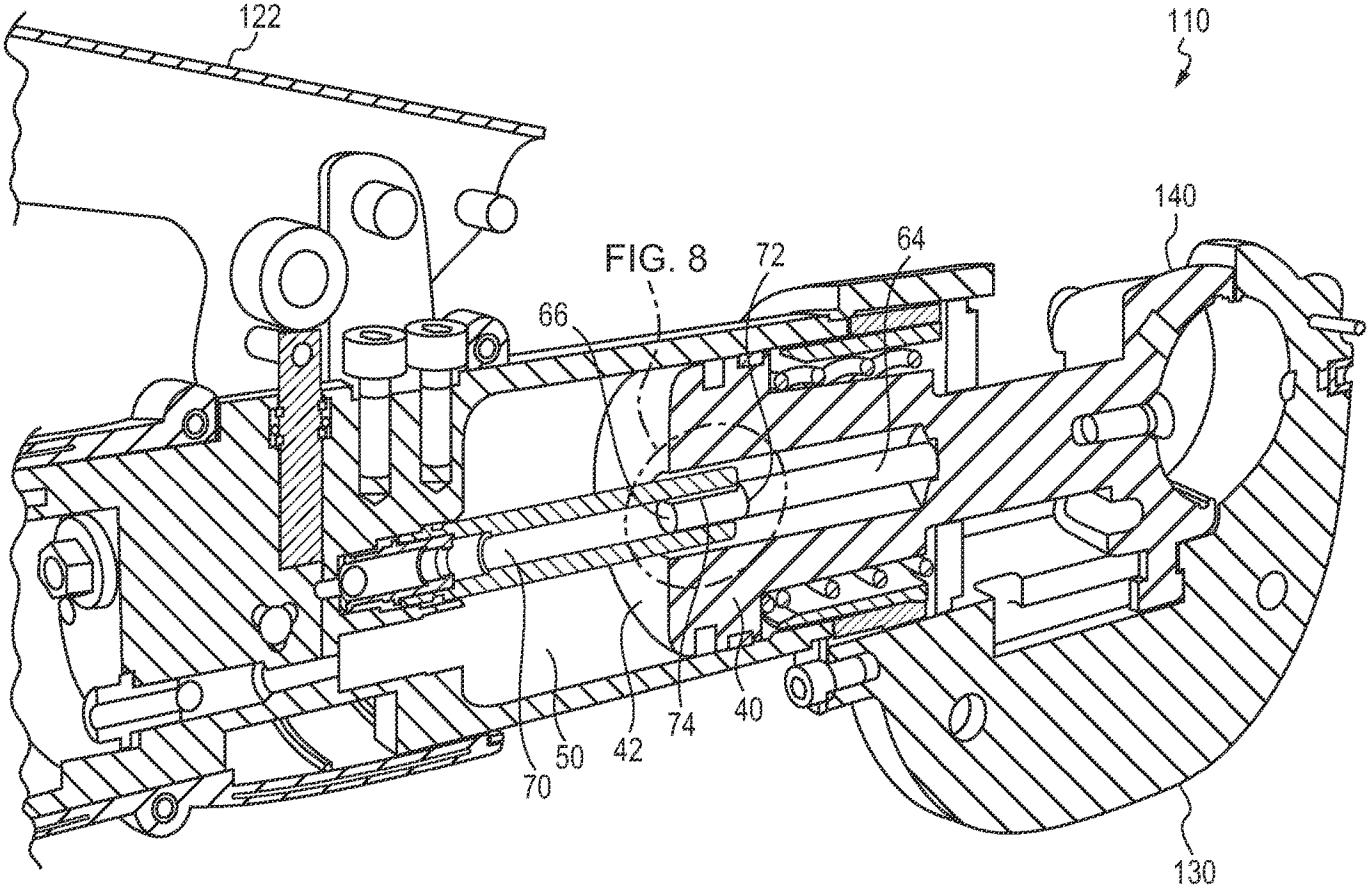
FIG. 7 is a detailed schematic sectional view of the tool of FIG. 6 illustrating the hydraulic assembly and pushrod when the tool is in a state of ram extension.

FIG. 7 is a detailed schematic sectional view of the tool 110 shown in FIG. 6 in a fully extended state, illustrating the free flow feature in association with the pushrod 64. Specifically, the pushrod 64 includes the previously described recessed band 72 and the flat face 74 extending between the first face 66 of the pushrod 64 and the band 72. As can be seen in FIG. 7, the volume of the primary chamber 50 reaches its maximum volume as a result of the ram 40 being fully extended. Similarly, the volume of the secondary chamber 70 reaches its maximum volume as a result of the pushrod 64 being fully extended.

Figure 8:
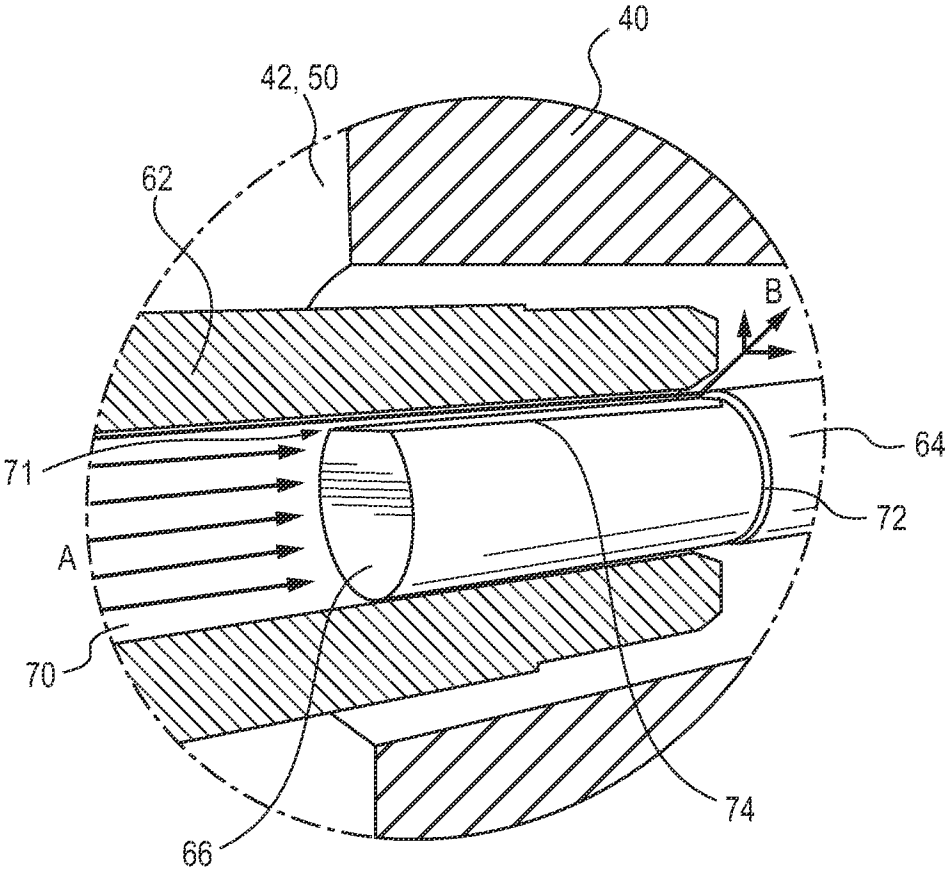
FIG. 8 is a further detailed schematic view of a rear portion of the pushrod illustrating flow of hydraulic fluid when the tool is in a state of ram extension.

FIG. 8 is a further detailed schematic view illustrating the free flow feature of the present subject matter. The pushrod 64 is extended past a transition position relative to the housing 62 such that hydraulic fluid from the secondary chamber 70, depicted by fluid flow lines A, can pass along the flat face region 74 shown as interface 71, and flow into the primary chamber 50, depicted by fluid flow lines B.

Figure 9:
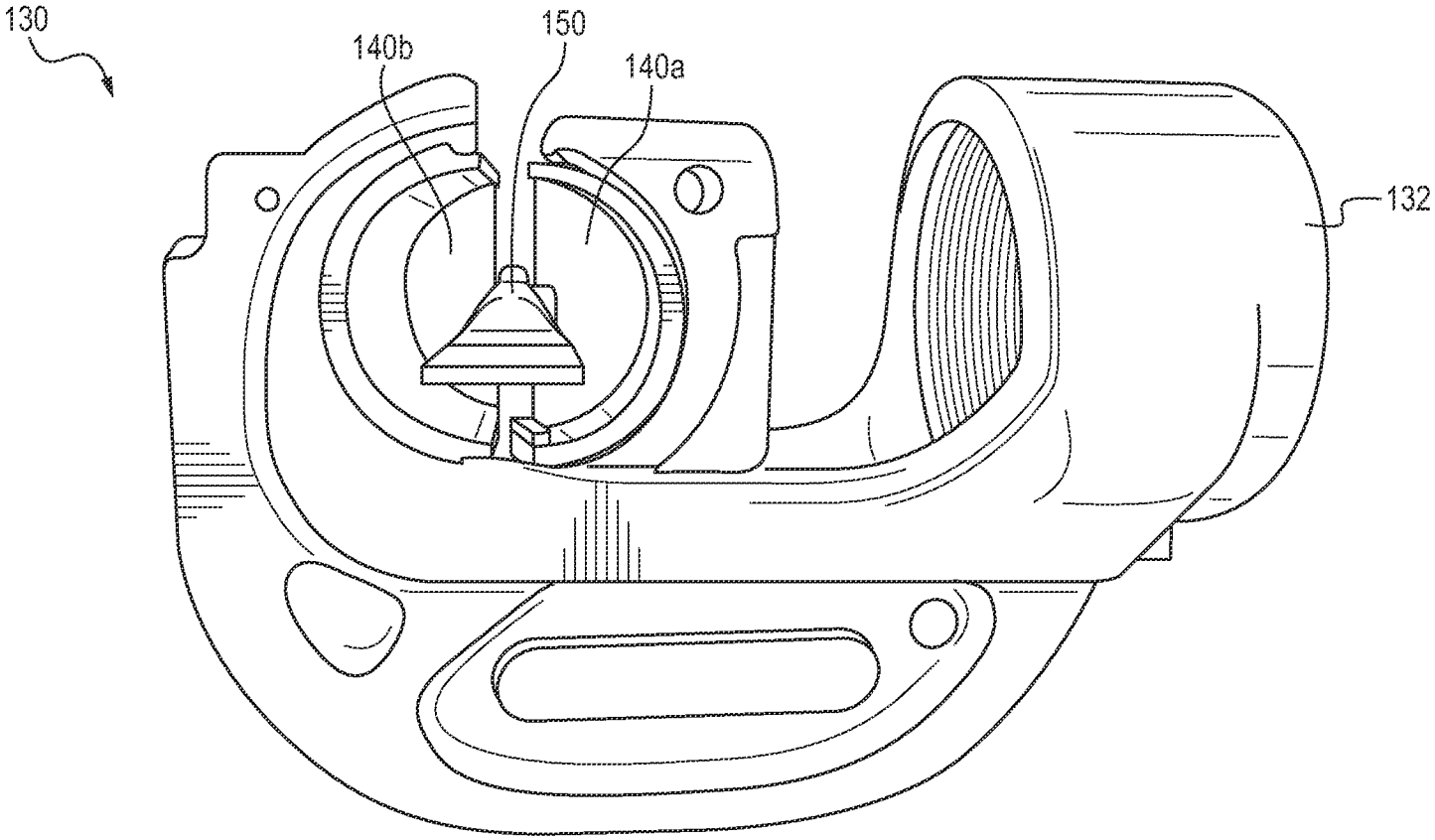
FIG. 9 is a side elevational view of a typical crimp head of a hydraulic tool illustrating a representative position of crimping dies when the tool is in a state of ram extension.

FIG. 9 is a side elevational view of a tool head 130 in the form of a crimp head. The head 130 includes attachment provisions 132 for attaching or securing the tool head 130 to a tool body such as the tool body or frame 120 shown in FIGS. 4, 6, and 7. The attachment provisions 132 can include a region of threads or utilize other assemblies to securely affix the head. The head 130 also includes one or more work members such as a moveable die member 140*a* and a stationary die member 140*b*. FIG. 9 also illustrates a representative workpiece 150 typically disposed between the members 140*a*, 140*b*.

Various methods of using the hydraulic system 10 and/or the tool 110 are as follows. Referring to FIGS. 1, 4, and 5, an operator or user typically obtains the tool 110 in a state of ram retraction due to biasing spring 46 or other member urging the ram 40 and the pushrod 64 to a fully retracted position. Upon placement of a workpiece in the tool head 130, the operator begins to pump or otherwise displace the pump handle 122 thereby causing the pump 20 to draw hydraulic fluid from the reservoir 80 through the pump inlet line 24, through the pump, and then exit the pump via the pump outlet line 26. Hydraulic fluid then is directed into the inlet lines 31 and 32 for the primary and secondary chambers, respectively. As previously described, the valves 27 and 28 and their associated springs or biasing components that urge the valves closed, are such that the valve 28 opens at pressures that are less than the valve opening pressure associated with the valve 27. Thus, the inlet line 32 to the secondary chamber 70 opens first, thereby allowing hydraulic fluid flow from the pump 20 to the secondary chamber 70.

Continued operation of the pump 20 results in additional fluid directed into the secondary chamber 70 thereby causing extension of the pushrod 64. Referring to FIGS. 4 and 5, extension of the pushrod 64 results in movement of the pushrod 64 in a rightward direction. As previously described, extension of the pushrod 64 results in extension of the ram 40. In certain embodiments, the second end 68 of the pushrod 64 and particularly the reduced surface area end contacts the first face 42 of the ram 40. However, it will be understood that the present subject matter includes a wide array of assemblies and additional components can be used to transfer displacement of the pushrod to cause displacement of the ram.

Pumping of the handle 122 continues and hydraulic fluid is continued to be directed through the inlet line 32 into the secondary chamber 70 thereby causing extension of the pushrod 64 and the ram 40. Linear displacement of the pushrod 64 continues through a range of positions relative to the housing 62 which correspond to the first phase of ram extension. As previously noted, the rate of extension of the pushrod and ram is relatively fast. While the pushrod 64 is within this range of positions corresponding to the first phase, fluid communication between the first and secondary chambers 50 and 70 is precluded. This is achieved by the flat region 72 of the pushrod 64 being sufficiently spaced from an end of the housing 62 at which the primary chamber 50 is accessible. Thus, the position of the pushrod is such that the interface 71 does not extend to the end of the housing. For versions of pushrods 64 having the recessed bands 72, the band is spaced from the end of the housing 62 at which the primary chamber 50 is accessible.

Continued pumping causes additional hydraulic fluid to enter the secondary chamber 70, and extend the pushrod 64 until fluid communication can occur between the secondary chamber 70 and the primary chamber 50. This typically occurs at a location of the ram relatively close to a fully extended position such as at least 80% of ram full extension, in certain embodiments at least 90% of ram full extension and in still other embodiments at least 95% of ram full extension. For applications in which no or minimal loads are placed upon the ram, as the pushrod reaches this transition location, i.e., the pushrod position between the first and second phases of ram extension, an operator may experience a reduction in pumping pressure at the handle 122. This is due to hydraulic fluid entering the primary chamber 50 instead of causing ram extension.

Eventually as pumping continues, the ram advances until resistance is encountered, i.e., a work or crimping operation is begun. Continued pumping results in an increase in fluid pressure until eventually the pressure at valve 27 exceeds the bias pressure to open that valve and allow fluid flow into the primary chamber 50 via the inlet line 31. Additional fluid is directed into the primary chamber 50 and as a result of the relatively large surface area of the face 42 of the ram 40, relatively high compressive forces can be delivered by the ram 40 with continued extension. Fluid flow through the inlet line 32 may continue into the secondary chamber 70. Work such as crimping can be performed during this second phase of ram extension.

Figure 10:
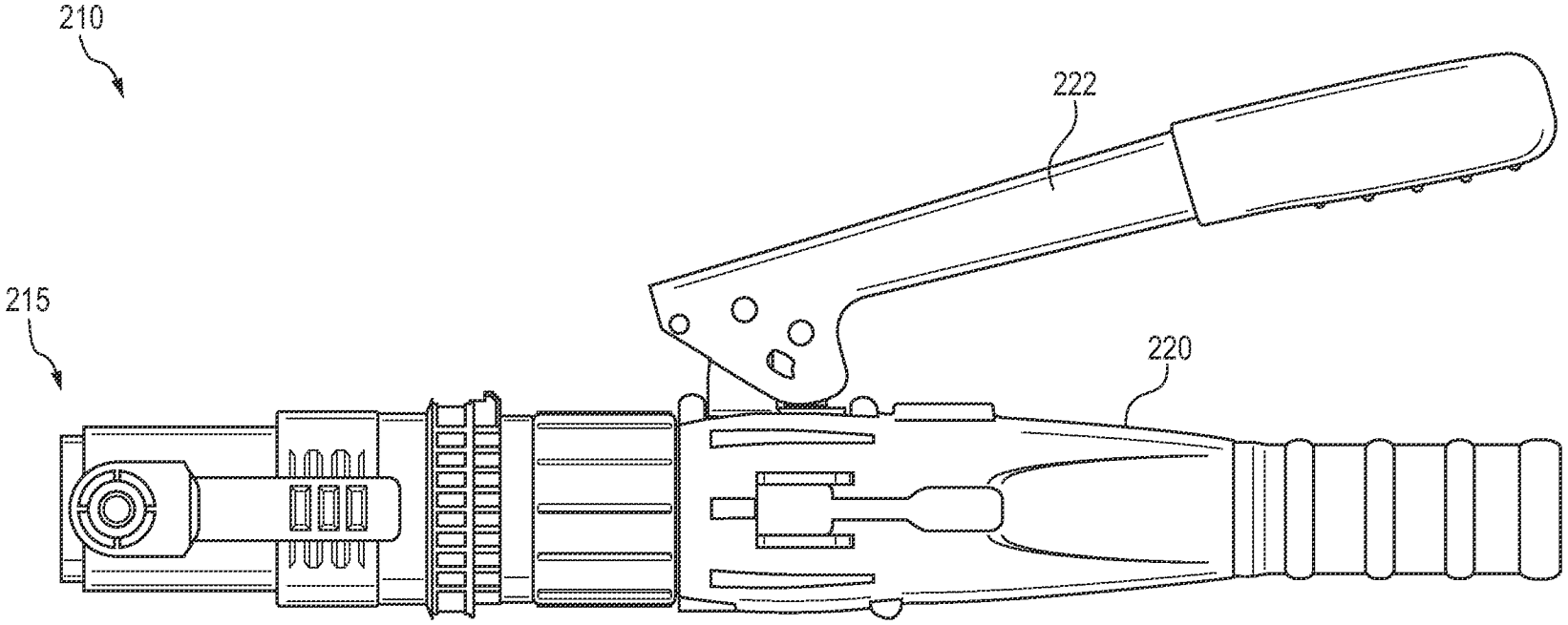
FIG. 10 is a side elevational view of another hydraulic tool in accordance with the present subject matter in which the tool includes a head end configured for use with one or more separable work heads (not shown).

The present subject matter hydraulic systems are particularly well suited for incorporation in handheld hydraulic tools such as for example manually powered hydraulic tools such as the tool 210 depicted in FIG. 10. The tool 210 includes a tool body 220 having a pump handle 222, and a tool head end 215. The tool 210 also includes the previously noted hydraulic system 10 generally disposed in the tool body 220. One or more tool or work heads (not shown) may be releasably engaged with the tool body 220 and particularly, at the tool head end 215.

Figure 11:
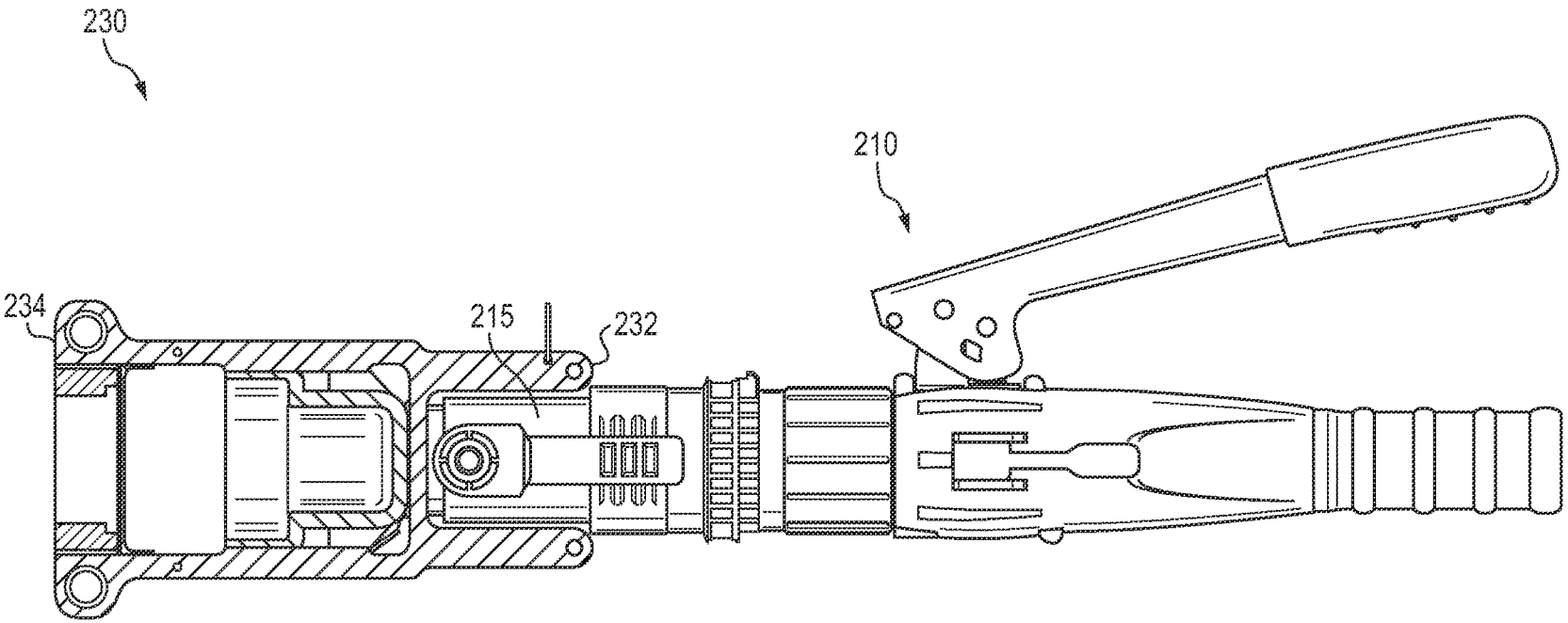
FIG. 11 is a side elevational view of the hydraulic tool depicted in FIG. 10 having a work head engaged at the head end of the tool.

FIG. 11 is a side elevational view of the hydraulic tool 210 depicted in FIG. 11 having a work head 230 engaged at the head end 215 of the tool 210. The work head 230 is sized and shaped to be engaged with, and removed from, the head end 215. The work head 230 typically defines a proximal end 232 and an oppositely directed distal end 234. Although the work head 230 can be provided n a wide array of shapes and configurations, in many versions the proximal end 232 is cylindrical in shape and defines a cylindrical bore or interior region sized and shaped to receive the tool head end 215, which in many versions is generally cylindrical. Corresponding apertures can be provided in both the tool head end 215 and the proximal end 232 which, when aligned, can receive engagement pins (not shown) that selectively engage the work head 230 to the head end 215 of the tool 210.

It will be understood that the tool 210 can be used in conjunction with a variety of different work heads. For example, the tool 210 can potentially be used with works heads adapted for performing crimping, pressing, forming, cutting, or other operations. A nonlimiting example of a specific type of work head that could be engaged at the head end 215 of the tool 210 is a press frame such as described in U.S. Pat. No. 7,979,980.

Many other benefits will no doubt become apparent from future application and development of this technology.

All patents, published applications, standards and articles noted herein are hereby incorporated by reference in their entirety.

It will be understood that any one or more feature or component of one embodiment described herein can be combined with one or more other features or components of another embodiment. Thus, the present invention includes any and all combinations of components or features of the embodiments described herein.

As described hereinabove, the present subject matter solves many problems associated with previous strategies, systems and/or devices. However, it will be appreciated that various changes in the details, materials and arrangements of components, which have been herein described and illustrated in order to explain the nature of the present subject matter, may be made by those skilled in the art without departing from the principle and scope of the claimed subject matter, as expressed in the appended claims.

What is claimed is:

1. A hydraulic system comprising:

a reservoir adapted to contain hydraulic fluid;

a hydraulic cylinder defining a hollow interior and including a ram disposed therein, the ram defining a first face and an oppositely directed second working face, the interior of the cylinder and the first face of the ram defining a primary chamber, the ram positionable through a first phase of ram extension and a second phase of ram extension;

a pushrod assembly including a housing defining a hollow interior and a pushrod positionably disposed therein, the pushrod defining a first end and an oppositely directed second end, the interior of the housing and the first end of the pushrod defining a secondary chamber, the pushrod and the ram being in at least periodic operable engagement such that extension of the pushrod causes extension of the ram;

wherein the pushrod and housing include provisions to preclude fluid flow between the primary chamber and the secondary chamber when the pushrod is within a range of positions corresponding to the first phase of ram extension, and permit fluid flow between the primary chamber and the secondary chamber when the pushrod is within a range of positions corresponding to the second phase of ram extension, wherein the provisions include the pushrod defining a circumferential outer surface generally extending between the first end and the second end of the pushrod and a flat surface region extending along a length portion of the pushrod from the first end of the pushrod.

2. The hydraulic system of claim 1 wherein the provisions further include a recessed band extending around at least a portion of the circumference of the pushrod, the recessed band located between the first end and the second end of the pushrod.

3. The hydraulic system of claim 2 wherein the recessed band extends entirely around the circumference of the pushrod.

4. The hydraulic system of claim 2 wherein the flat surface region extends between the first end of the pushrod and the recessed band.

5. The hydraulic system of claim 2 wherein the recessed band is located along the length of the pushrod at a transition location between the range of positions corresponding to the first phase of ram extension and the range of positions corresponding to the second phase of ram extension.

6. A hydraulic system comprising:

a reservoir adapted to contain hydraulic fluid;

a hydraulic cylinder defining a hollow interior and including a ram disposed therein, the ram defining a first face and an oppositely directed second working face, the interior of the cylinder and the first face of the ram defining a primary chamber, the ram positionable through a first phase of ram extension and a second phase of ram extension;

a pushrod assembly including a housing defining a hollow interior and a pushrod positionably disposed therein, the pushrod defining a first end and an oppositely directed second end, the interior of the housing and the first end of the pushrod defining a secondary chamber, the pushrod and the ram being in at least periodic operable engagement such that extension of the pushrod causes extension of the ram;

wherein the pushrod and housing include provisions to preclude fluid flow between the primary chamber and the secondary chamber when the pushrod is within a range of positions corresponding to the first phase of ram extension, and permit fluid flow between the primary chamber and the secondary chamber when the pushrod is within a range of positions corresponding to the second phase of ram extension, wherein the pushrod assembly is free of seals disposed between the pushrod and the interior of the housing.

7. A hydraulic system comprising:

a reservoir adapted to contain hydraulic fluid;

a hydraulic cylinder defining a hollow interior and including a ram disposed therein, the ram defining a first face and an oppositely directed second working face, the interior of the cylinder and the first face of the ram defining a primary chamber, the ram positionable through a first phase of ram extension and a second phase of ram extension;

a pushrod assembly including a housing defining a hollow interior and a pushrod positionably disposed therein, the pushrod defining a first end and an oppositely directed second end, the interior of the housing and the first end of the pushrod defining a secondary chamber, the pushrod and the ram being in at least periodic operable engagement such that extension of the pushrod causes extension of the ram;

wherein the pushrod and housing include provisions to preclude fluid flow between the primary chamber and the secondary chamber when the pushrod is within a range of positions corresponding to the first phase of ram extension, and permit fluid flow between the primary chamber and the secondary chamber when the pushrod is within a range of positions corresponding to the second phase of ram extension, wherein the provisions direct fluid flow between the primary chamber and the secondary chamber based upon a position of the pushrod, a hydraulic fluid pump;

at least one fluid flow line extending between the reservoir and the primary chamber;

at least one fluid flow line extending between the pump and at least one of the primary chamber and the secondary chamber, wherein the at least one fluid flow line extending between the pump and at least one of the primary chamber and the secondary chamber includes:

a first fluid flow line providing fluid communication from the pump to the primary chamber; and a second fluid flow line providing fluid communication from the pump to the secondary chamber.

8. The hydraulic system of claim 7 wherein the first fluid flow line and the second fluid flow line are in parallel with one another.

9. The hydraulic system of claim 7 wherein the first fluid flow line includes a one way valve permitting fluid flow from the pump to the primary chamber at fluid pressures greater than a first pressure and precluding fluid flow from the primary chamber to the pump.

10. The hydraulic system of claim 9 wherein the second fluid flow line includes a one way valve permitting fluid flow from the pump to the secondary chamber at fluid pressures greater than a second pressure and precluding fluid flow from the secondary chamber to the pump.

11. A hydraulic system comprising:

a reservoir adapted to contain hydraulic fluid;

a hydraulic cylinder defining a hollow interior and including a ram disposed therein, the ram defining a first face and an oppositely directed second working face, the interior of the cylinder and the first face of the ram defining a primary chamber, the ram positionable through a first phase of ram extension and a second phase of ram extension;

a pushrod assembly including a housing defining a hollow interior and a pushrod positionably disposed therein, the pushrod defining a first end and an oppositely directed second end, the interior of the housing and the first end of the pushrod defining a secondary chamber, the pushrod and the ram being in at least periodic operable engagement such that extension of the pushrod causes extension of the ram;

wherein the pushrod and housing include provisions to preclude fluid flow between the primary chamber and the secondary chamber when the pushrod is within a range of positions corresponding to the first phase of ram extension, and permit fluid flow between the primary chamber and the secondary chamber when the pushrod is within a range of positions corresponding to the second phase of ram extension, a hydraulic fluid pump;

at least one fluid flow line extending between the reservoir and the primary chamber;

at least one fluid flow line extending between the pump and at least one of the primary chamber and the secondary chamber, wherein the at least one fluid flow line extending between the pump and at least one of the primary chamber and the secondary chamber includes:

a first fluid flow line providing fluid communication from the pump to the primary chamber; and a second fluid flow line providing fluid communication from the pump to the secondary chamber, wherein the first fluid flow line includes a one way valve permitting fluid flow from the pump to the primary chamber at fluid pressures greater than a first pressure and precluding fluid flow from the primary chamber to the pump, wherein the second fluid flow line includes a one way valve permitting fluid flow from the pump to the secondary chamber at fluid pressures greater than a second pressure and precluding fluid flow from the secondary chamber to the pump, wherein the first pressure is greater than the second pressure.

12. A hydraulic tool comprising:

a tool body;

a tool head secured to the tool body, the tool head including a positionable work member for performing at least one operation on a workpiece;

a hydraulic system generally disposed within the tool body, the hydraulic system including (i) a reservoir adapted to contain hydraulic fluid, (ii) a hydraulic cylinder defining a hollow interior and including a ram disposed therein, the ram defining a first face and an oppositely directed second working face, the interior of the cylinder and the first face of the ram defining a primary chamber, the ram positionable through a first phase of ram extension and a second phase of ram extension, and (iii) a pushrod assembly including a housing defining a hollow interior and a pushrod positionably disposed therein, the pushrod defining a first end and an oppositely directed second end, the interior of the housing and the first end of the pushrod defining a secondary chamber, the pushrod and the ram being in at least periodic operable engagement such that extension of the pushrod causes extension of the ram, wherein the pushrod and housing include provisions to preclude fluid flow between the primary chamber and the secondary chamber when the pushrod is within a range of positions corresponding to the first phase of ram extension, and permit fluid flow between the primary chamber and the secondary chamber when the pushrod is within a range of positions corresponding to the second phase of ram extension;

wherein the ram is engaged with the work member of the tool head, wherein the provisions include the pushrod defining a circumferential outer surface generally extending between the first end and the second end of the pushrod and a flat surface region extending along a length portion of the pushrod from the first end of the pushrod.

13. The hydraulic tool of claim 12 wherein the provisions further include a recessed band extending around at least a portion of the circumference of the pushrod, the recessed band located between the first end and the second end of the pushrod.

14. The hydraulic tool of claim 13 wherein the recessed band extends entirely around the circumference of the pushrod.

15. The hydraulic tool of claim 13 wherein the flat surface region extends between the first end of the pushrod and the recessed band.

16. The hydraulic tool of claim 13 wherein the recessed band is located along the length of the pushrod at a transition location between the range of positions corresponding to the first phase of ram extension and the range of positions corresponding to the second phase of ram extension.

17. A hydraulic tool comprising:

a tool body;

a tool head secured to the tool body, the tool head including a positionable work member for performing at least one operation on a workpiece;

a hydraulic system generally disposed within the tool body, the hydraulic system including (i) a reservoir adapted to contain hydraulic fluid, (ii) a hydraulic cylinder defining a hollow interior and including a ram disposed therein, the ram defining a first face and an oppositely directed second working face, the interior of the cylinder and the first face of the ram defining a primary chamber, the ram positionable through a first phase of ram extension and a second phase of ram extension, and (iii) a pushrod assembly including a housing defining a hollow interior and a pushrod positionably disposed therein, the pushrod defining a first end and an oppositely directed second end, the interior of the housing and the first end of the pushrod defining a secondary chamber, the pushrod and the ram being in at least periodic operable engagement such that extension of the pushrod causes extension of the ram, wherein the pushrod and housing include provisions to preclude fluid flow between the primary chamber and the secondary chamber when the pushrod is within a range of positions corresponding to the first phase of ram extension, and permit fluid flow between the primary chamber and the secondary chamber when the pushrod is within a range of positions corresponding to the second phase of ram extension;

wherein the ram is engaged with the work member of the tool head, wherein the pushrod assembly is free of seals disposed between the pushrod and the interior of the housing.

18. A hydraulic tool comprising:

a tool body;

a tool head secured to the tool body, the tool head including a positionable work member for performing at least one operation on a workpiece;

a hydraulic system generally disposed within the tool body, the hydraulic system including (i) a reservoir adapted to contain hydraulic fluid, (ii) a hydraulic cylinder defining a hollow interior and including a ram disposed therein, the ram defining a first face and an oppositely directed second working face, the interior of the cylinder and the first face of the ram defining a primary chamber, the ram positionable through a first phase of ram extension and a second phase of ram extension, and (iii) a pushrod assembly including a housing defining a hollow interior and a pushrod positionably disposed therein, the pushrod defining a first end and an oppositely directed second end, the interior of the housing and the first end of the pushrod defining a secondary chamber, the pushrod and the ram being in at least periodic operable engagement such that extension of the pushrod causes extension of the ram, wherein the pushrod and housing include provisions to preclude fluid flow between the primary chamber and the secondary chamber when the pushrod is within a range of positions corresponding to the first phase of ram extension, and permit fluid flow between the primary chamber and the secondary chamber when the pushrod is within a range of positions corresponding to the second phase of ram extension;

wherein the ram is engaged with the work member of the tool head, wherein the provisions direct fluid flow between the primary chamber and the secondary chamber based upon a position of the pushrod, wherein the hydraulic system further includes (iv) a hydraulic fluid pump, (v) at least one fluid flow line extending between the reservoir and the primary chamber, and (vi) at least one fluid flow line extending between the pump and at least one of the primary chamber and the secondary chamber, wherein the at least one fluid flow line extending between the pump and at least one of the primary chamber and the secondary chamber includes:

a first fluid flow line providing fluid communication from the pump to the primary chamber; and a second fluid flow line providing fluid communication from the pump to the secondary chamber.

19. The hydraulic tool of claim 18 wherein the first fluid flow line and the second fluid flow line are in parallel with one another.

20. The hydraulic tool of claim 18 wherein the first fluid flow line includes a one way valve permitting fluid flow from the pump to the primary chamber at fluid pressures greater than a first pressure and precluding fluid flow from the primary chamber to the pump.

21. The hydraulic tool of claim 20 wherein the second fluid flow line includes a one way valve permitting fluid flow from the pump to the secondary chamber at fluid pressures greater than a second pressure and precluding fluid flow from the secondary chamber to the pump.

22. A hydraulic tool comprising:

a tool body;

a tool head secured to the tool body, the tool head including a positionable work member for performing at least one operation on a workpiece;

a hydraulic system generally disposed within the tool body, the hydraulic system including (i) a reservoir adapted to contain hydraulic fluid, (ii) a hydraulic cylinder defining a hollow interior and including a ram disposed therein, the ram defining a first face and an oppositely directed second working face, the interior of the cylinder and the first face of the ram defining a primary chamber, the ram positionable through a first phase of ram extension and a second phase of ram extension, and (iii) a pushrod assembly including a housing defining a hollow interior and a pushrod positionably disposed therein, the pushrod defining a first end and an oppositely directed second end, the interior of the housing and the first end of the pushrod defining a secondary chamber, the pushrod and the ram being in at least periodic operable engagement such that extension of the pushrod causes extension of the ram, wherein the pushrod and housing include provisions to preclude fluid flow between the primary chamber and the secondary chamber when the pushrod is within a range of positions corresponding to the first phase of ram extension, and permit fluid flow between the primary chamber and the secondary chamber when the pushrod is within a range of positions corresponding to the second phase of ram extension;

wherein the ram is engaged with the work member of the tool head, wherein the hydraulic system further includes (iv) a hydraulic fluid pump, (v) at least one fluid flow line extending between the reservoir and the primary chamber, and (vi) at least one fluid flow line extending between the pump and at least one of the primary chamber and the secondary chamber, wherein the at least one fluid flow line extending between the pump and at least one of the primary chamber and the secondary chamber includes:

a first fluid flow line providing fluid communication from the pump to the primary chamber; and a second fluid flow line providing fluid communication from the pump to the secondary chamber, wherein the first fluid flow line includes a one way valve permitting fluid flow from the pump to the primary chamber at fluid pressures greater than a first pressure and precluding fluid flow from the primary chamber to the pump, wherein the second fluid flow line includes a one way valve permitting fluid flow from the pump to the secondary chamber at fluid pressures greater than a second pressure and precluding fluid flow from the secondary chamber to the pump, wherein the first pressure is greater than the second pressure.

* * * * *